US011242717B2

(12) United States Patent
Al-Badran et al.

(10) Patent No.: US 11,242,717 B2
(45) Date of Patent: Feb. 8, 2022

(54) ROTATIONAL CONTINUOUS CIRCULATION TOOL

(71) Applicant: Saudi Arabian Oil Company, Dhahran (SA)

(72) Inventors: Mohammad Saud Al-Badran, Dhahran (SA); Chinthaka Pasan Gooneratne, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/885,444

(22) Filed: May 28, 2020

(65) Prior Publication Data

US 2021/0372208 A1 Dec. 2, 2021

(51) Int. Cl.

| | |
|---|---|
| ***E21B 19/16*** | (2006.01) |
| ***E21B 21/10*** | (2006.01) |
| ***E21B 34/00*** | (2006.01) |
| ***E21B 21/01*** | (2006.01) |
| ***E21B 3/02*** | (2006.01) |

(52) U.S. Cl.

CPC ..... *E21B 19/16* (2013.01); *E21B 21/019* (2020.05); *E21B 21/106* (2013.01); *E21B 34/00* (2013.01); *E21B 3/022* (2020.05); *E21B 2200/04* (2020.05)

(58) Field of Classification Search

CPC ..... E21B 19/16; E21B 21/019; E21B 34/00; E21B 21/106; E21B 3/022; E21B 2200/04

See application file for complete search history.

(56) References Cited

U.S. PATENT DOCUMENTS

| | | | | |
|---|---|---|---|---|
| 3,298,385 | A | 1/1967 | Jackson et al. | |
| 6,315,051 | B1 * | 11/2001 | Ayling | E21B 19/16 166/380 |
| 6,591,916 | B1 * | 7/2003 | Ayling | E21B 19/16 166/380 |
| 8,033,338 | B2 | 10/2011 | Springett | |
| 8,627,890 | B2 | 1/2014 | Bailey et al. | |

(Continued)

FOREIGN PATENT DOCUMENTS

| | | | |
|---|---|---|---|
| WO | 2012141870 | A2 | 10/2012 |
| WO | 2018136451 | A1 | 7/2018 |

OTHER PUBLICATIONS

International Search Report and Written Opinion for International Application No. PCT/US2021/070627, report dated Jul. 23, 2021; pp. 1-12.

*Primary Examiner* — Tara Schimpf
*Assistant Examiner* — Jonathan Malikasim
(74) *Attorney, Agent, or Firm* — Bracewell LLP; Constance G. Rhebergen; Vivek P. Shankam

(57) ABSTRACT

A tool circulates drilling fluid through and rotates a pipe string while making up or breaking out a stand of pipe. The tool includes a clad configured to grip and seal around the RCCT sub. The clad includes a body portion, an inner ring configured to selectively rotate independently, an outer ring configured to be stationary with respect to the inner ring, the outer ring having at least two annular protrusions, a first arm configured to engage with a first annular protrusion, a second arm configured to engage with a second annular protrusion, and a stinger configured to latch into the at least one side entry port and allow the sub and the drill pipe string to rotate independent of the clad. The clad is configured to avoid or prevent stuck pipe incidents.

17 Claims, 6 Drawing Sheets

(56) References Cited

U.S. PATENT DOCUMENTS

| | | | | |
|---|---|---|---|---|
| 8,794,351 | B2 | 8/2014 | Krohn et al. | |
| 8,826,992 | B2 * | 9/2014 | Zhou | E21B 21/106 166/376 |
| 9,725,955 | B2 | 8/2017 | Skjaerseth et al. | |
| 9,777,544 | B2 | 10/2017 | Skjaerseth et al. | |
| 11,002,074 | B1 * | 5/2021 | Calleri | E21B 21/12 |
| 2006/0278434 | A1 | 12/2006 | Calderoni et al. | |
| 2012/0261138 | A1 | 10/2012 | Zhou | |
| 2016/0222743 | A1 | 8/2016 | Gosney | |
| 2018/0202247 | A1 | 7/2018 | Johnson et al. | |

* cited by examiner

ROTATIONAL CONTINUOUS CIRCULATION TOOL

TECHNICAL FIELD

Embodiments relate in general to making up and breaking out pipe connections during drilling operations and, in particular, to a tool for allowing circulation of fluid through and rotation of a pipe string while making up or breaking out pipe connections.

BACKGROUND

In conventional drilling operations, well bores are drilled with a drill bit on the end of a pipe string that is rotated by means of a rotary table or a top drive. The top drive is coupled to the upper end of the pipe string and provides the necessary torque to rotate the drill bit for continued drilling. Typically, a pump circulates drilling mud through the top drive and down the pipe string to the drill bit during drilling operations. Continued pumping through the top drive forces the drilling mud at the bottom of the wellbore back up the wellbore on the outside of the pipe string, where the drilling mud returns to a drilling mud tank system. The circulating drilling mud cools and cleans the drill bit, bringing the debris and cuttings produced by the drilling process to the surface of the wellbore. Continued drilling draws the pipe string further into the wellbore, eventually requiring another stand of pipe to be added to the pipe string.

In most prior art drilling methods, when a new stand is added to or removed from the pipe string, rotation of the pipe string, and thus drilling, must cease for the duration of the period needed to complete the new joint make up. Prolonged periods without rotation causes prolonged static contact between the formation surrounding the pipe string and the pipe string. This static contact increases the risk of the pipe string becoming stuck in the wellbore. A stuck pipe string causes significant problems for the drilling operation that must be overcome at great expense of time and money. Therefore, there is a need for a device that allows for continuous or nearly continuous rotation of the pipe string while making up or breaking out a new stand.

Circulation of the drilling mud through the pipe string must also cease for the duration of the period needed to add a stand to or remove a stand from the pipe string. When circulation of drilling mud stops, the pressure on the wellbore can significantly decrease. This can cause sections of the wellbore to cave in, or allow the higher pressure of the surrounding formation to cause a blowout of the well. Particularly in a blowout event, this can cause significant risk to property and life. In addition, the cuttings or other debris produced by the drilling process that are carried up and out of the wellbore by the drilling mud may settle when circulation stops, binding the drill bit or causing the pipe string to become stuck. Again, a bound drill bit or stuck pipe string can cause significant problems for the drilling operation that must be overcome at great expense of time and money. Therefore, there is a need for a device that provides continuous or nearly continuous circulation of drilling mud through the pipe string during stand make up or break out.

Various attempts to overcome the problems associated with pipe string make up and break out have been tried. For example, some prior art devices couple a cylinder type device around the pipe string and stand to be joined. The devices employ various sealing elements to alternately close off the pipe string or the stand during make up or break out. Drilling mud circulates into the pipe string through a connection at the cylinder while the stand is being made up or broken out, allowing for continuous circulation. Typically, the devices are quite complex and, to properly operate the device, necessitate the addition of costly and space consuming equipment to the drilling rig. In addition, while these devices continue circulation of the drilling mud, they cannot maintain rotation of the pipe string while a new stand is made up or broken out. Their inability to maintain rotation continues to cause stuck pipe string problems.

Other attempts to overcome these problems couple an element inline with the pipe string at every new stand; the element providing an alternate drilling mud circulation path. These elements provide a coupling for a drilling mud circulation device to attach to during stand make up or break out. The elements typically contain a valve at an upper end of the element that directs drilling mud flow down the pipe string and not back up the new stand when drilling mud circulates along the alternate circulation path. In this manner, these inline elements achieve continuous circulation through the pipe string. However, as above, the inline elements do not provide a solution to achieve continuous rotation. Therefore, there is a need for a device that can maintain continuous circulation and rotation during make up or break out of a stand.

SUMMARY

These and other problems are generally solved or circumvented, and technical advantages are generally achieved, by preferred embodiments of the present invention that provide a rotational continuous circulation tool, and a method for using the same.

In accordance with an embodiment of the present invention, a rotational continuous circulation tool (RCCT) for connection into a drill pipe string comprises a sub defining a central bore having an axis, the sub having upper and lower ends for connection into a drill pipe string. The sub further comprises an upper tubular member and a lower tubular member. The upper tubular member and the lower tubular member are configured to selectively rotate independently and in unison. The sub includes a central bore valve coupled to the upper tubular member to selectively open and close the central bore, and at least one side entry port in a sidewall of the upper tubular member axially below the central valve for selectively allowing drilling fluid to be injected into the central bore. The tool includes a clad configured to grip and seal around the RCCT sub. The clad includes a body portion, an inner ring configured to selectively rotate independently, an outer ring configured to be stationary with respect to the inner ring, the outer ring having at least two annular protrusions, a first arm configured to engage with a first annular protrusion, a second arm configured to engage with a second annular protrusion, and a stinger configured to latch into the at least one side entry port and allow the sub and the drill pipe string to rotate independent of the clad. The clad is configured to avoid or prevent stuck pipe incidents.

In accordance with another embodiment of the present invention, an improvement is located in a drilling rig having a top drive configured to pass drilling fluid through and rotate a pipe string. The improvement comprises a rotary table mounted in the drilling rig below the top drive, wherein the rotary table is configured to suspend and rotate the pipe string. The improvement also includes a sub defining a central bore having an axis, the sub coupled into the pipe string. The sub comprises an upper tubular member and a lower tubular member. The upper tubular member and the lower tubular member are configured to selectively rotate independently and in unison. The sub further comprises a central bore valve coupled to the upper tubular member to selectively open and close the central bore. In addition, the sub comprises at least one side entry port in a sidewall of the upper tubular member axially below the central valve for selectively allowing drilling fluid to be injected into the central bore. The side entry port comprises a check valve that when depressed, allows drilling fluid to be injected through the side entry port into the central bore. Bearings are located between the upper and lower tubular members. Finally, the sub includes an anti-rotation member accessible from an exterior of the sub for selectively locking the upper and lower tubular members together for rotation therewith. The tool includes a clad configured to grip and seal around the RCCT sub. The clad includes a body portion, an inner ring configured to selectively rotate independently, an outer ring configured to be stationary with respect to the inner ring, the outer ring having at least two annular protrusions, a first arm configured to engage with a first annular protrusion, a second arm configured to engage with a second annular protrusion, and a stinger configured to latch into the at least one side entry port and allow the sub and the drill pipe string to rotate independent of the clad. The clad is configured to avoid or prevent stuck pipe incidents.

In accordance with yet another embodiment of the present invention, a method for circulating fluid through a drill pipe string supported by a rig drive of a drilling rig while rotating the drill pipe string during make up or break out comprises connecting a rotational continuous circulation tool (RCCT) to a top of each drill pipe stand used to form a drill pipe string, the RCCT having upper and lower portions that are selectively rotatable independently of each other. The method continues by lowering the drill pipe string with the rig drive until the RCCT is proximate to and above a rotary table of the drilling rig. The method continues to rotate and pump drilling fluid through the rig drive and drill pipe string. Next, the method engages the drill pipe string in the rotary table, and then, rotates the drill pipe string and the lower portion of the RCCT with the rotary table while the upper portion of the RCCT remains stationary. The method then proceeds by closing a central bore valve of the RCCT to block flow of fluid from the rig drive, and then stabbing an injection tube into a side entry port of the upper portion of the RCCT and circulating fluid through the RCCT and the drill pipe string. Next, the method decouples the rig drive from the RCCT, and then, couples another section of pipe between the rig drive and the RCCT. Finally, the method disengages the pipe string from the rotary table, and continues operations with the rig drive.

An advantage of a preferred embodiment is that the apparatus provides a rotational continuous circulation tool for use with top drive systems that can circulate fluid through a pipe string while continuing to rotate the pipe string during stand make up or break out. This diminishes problems associated with stuck pipe strings and drill bits due to static contact between the pipe string and the wellbore.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION

The particulars shown here are by way of example and for purposes of illustrative discussion of the examples of the subject disclosure only, and are presented in the cause of providing what is believed to be the most useful and readily understood description of the principles and conceptual aspects of the subject disclosure. In this regard, no attempt is made to show more detail than is necessary, the description taken with the drawings making apparent to those skilled in the art how the several forms of the subject disclosure may be embodied in practice. Furthermore, like reference numbers and designations in the various drawings indicate like elements.

Figure 1A:
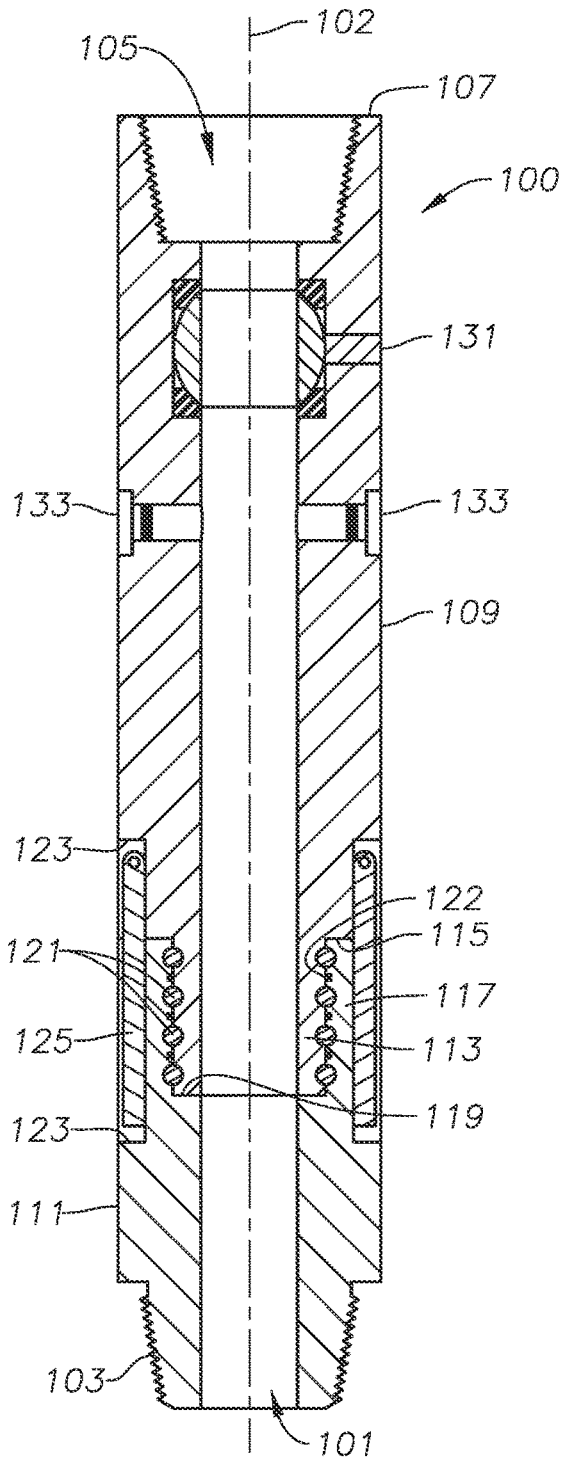
FIG. 1A is schematic sectional view of a rotational continuous circulation tool (RCCT) in accordance with an embodiment of the present invention.

Referring to FIG. 1A, a rotational continuous circulation tool (RCCT) 100 comprises a tubular member defining a central bore 101 having an axis 102. As illustrated, RCCT 100 comprises a tapered lower end 103 configured to couple to an upper end of a tubular element. Preferably, an exterior surface of tapered lower end 103 comprises threads. RCCT 100 further defines a conical recess 105 extending from an upper end 107 of RCCT 100 toward lower end 103. Recess 105 has a larger diameter at the upper end 107 and extends to a narrower diameter a predetermined length from the upper end 107. Preferably, a surface of recess 105 comprises threads allowing a subsequent tubular element to couple to RCCT 100. A person skilled in the art will understand that any suitable means for coupling lower end 103 and upper end 107 to tubular elements are contemplated and included in the disclosed embodiments.

RCCT 100 further comprises an upper tubular member 109 and a lower tubular member 111. Upper tubular member 109 and lower tubular member 111 are coaxial with axis 102 and upper tubular member 109 is above lower tubular member 111. Upper tubular member 109 comprises an inner annular protrusion 113 proximate to lower tubular member 111. Inner annular protrusion 113 extends from a downward facing shoulder 115 of upper tubular member 109 toward lower end 103. Inner annular protrusion 113 has an inner diameter surface that defines a portion of central bore 101. Downward facing shoulder 115 extends radially from a base of inner annular protrusion 113 to an exterior surface of upper annular member 109.

Lower tubular member 111 comprises an outer annular protrusion 117 adjacent to inner annular protrusion 113. Outer annular protrusion 117 extends from an upward facing shoulder 119 of lower tubular member 111 to and abutting downward facing shoulder 115. Similarly, inner annular protrusion 113 abuts upward facing shoulder 119. Outer annular protrusion 117 has an outer diameter surface that defines a portion of the exterior of lower tubular member 111. Upward facing shoulder 119 extends from a base of outer annular protrusion 117 radially inward to central bore 101. Outer annular protrusion 117 defines a cylindrical receptacle in which inner annular protrusion 113 is located.

A surface of inner annular protrusion 113 opposite central bore 101 abuts an interior surface of outer annular protrusion 117 opposite the exterior surface of lower tubular member 111, such that the combined thickness of inner annular protrusion 113 and outer annular protrusion 117 is equivalent to a wall thickness of RCCT 100. Interposed between inner and outer annular protrusions 113, 117 are a plurality of bearings 121. Bearings 121 are configured to allow lower tubular member 111 and upper tubular member 109 to rotate about the central bore 101 independently of each other while sealing the boundary between the inner annular protrusion 113 and the outer annular protrusion 117. In the exemplary embodiment, bearings 121 are rolling element type bearings such as ball bearings. The exemplary bearings are formed of a high quality grade steel, such as G-105 or S-135 grade steel, or similar. Bearings 121 provide some weight bearing capability such that when upper tubular member 109 is lifted vertically, upper tubular member 109 will not lift free of lower tubular member 111. Other embodiments may employ alternative bearing types such as plain type or fluid type bearings. If desired, bearings 121 may be removed for re-dressing and replacement; however, due to the short working duration of bearings 121, it is not anticipated that re-dressing or replacement will be necessary.

Figure 1B:
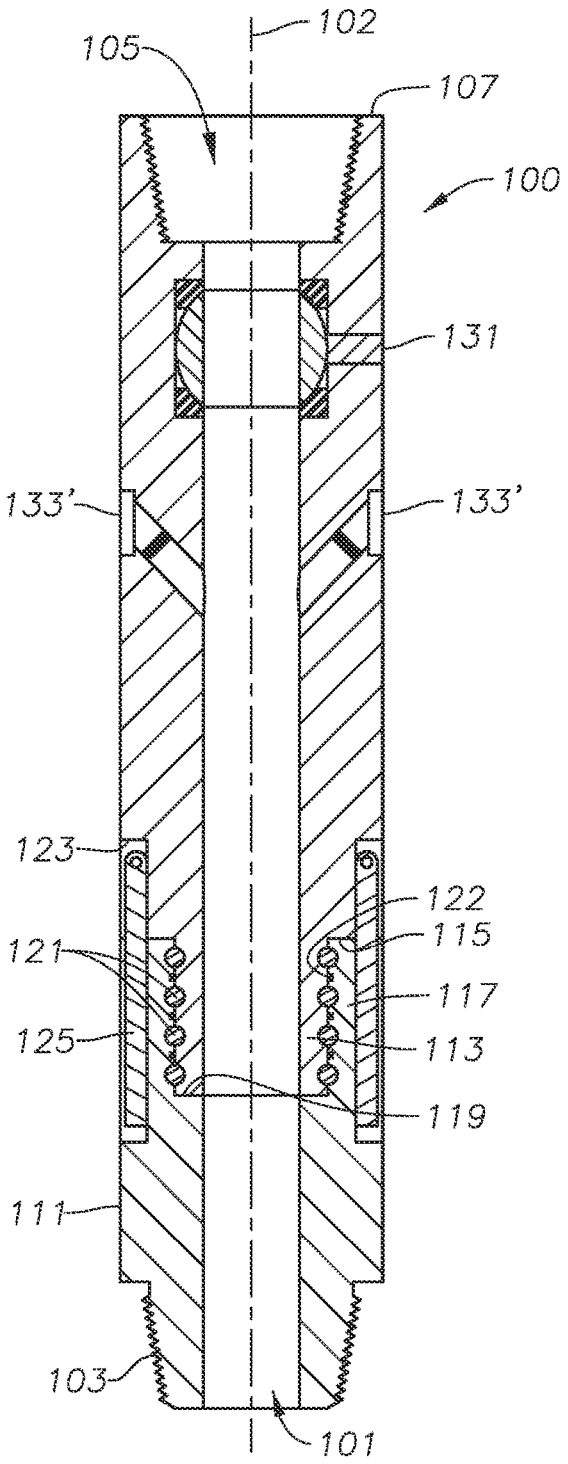
FIG. 1B is a schematic sectional view of a RCCT in accordance with an alternative embodiment of the present invention.
Figure 2:
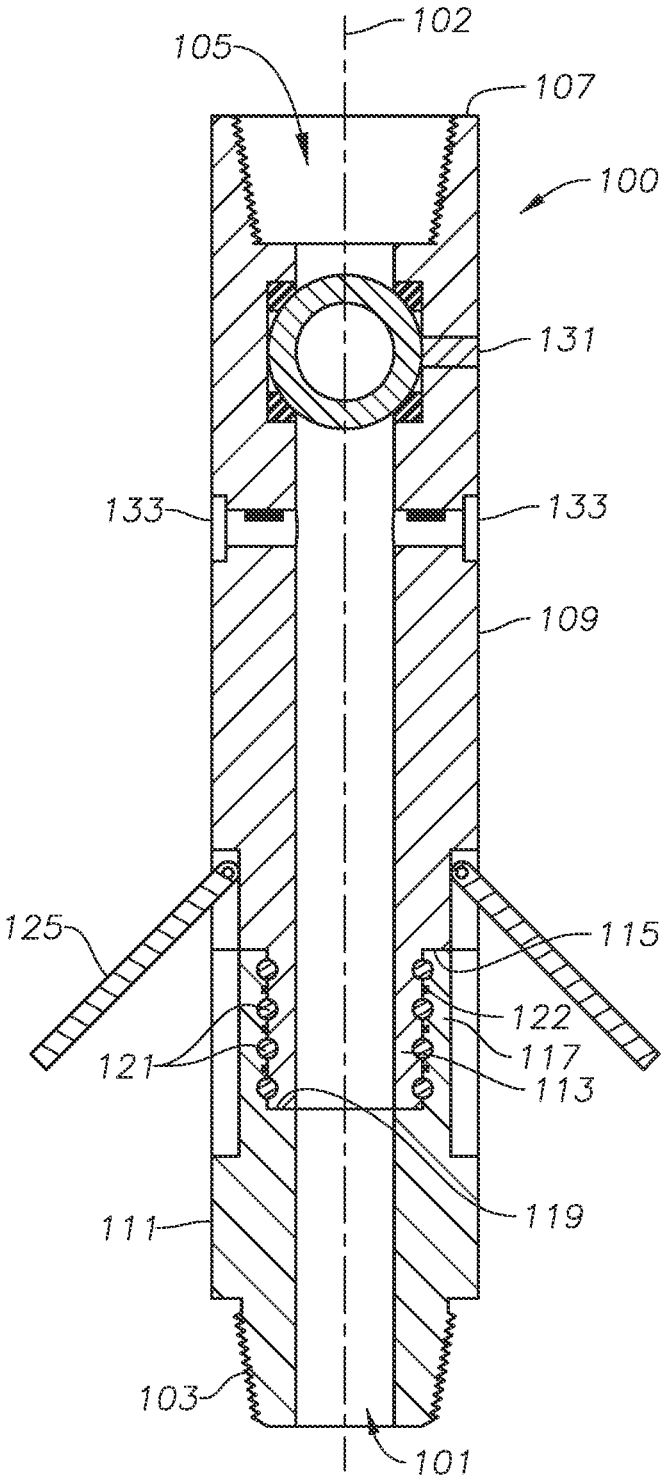
FIG. 2 is a schematic sectional view of the RCCT of FIG. 1, illustrating alternative operating positions of components of the RCCT of FIG. 1.

A person skilled in the art will understand that any suitable sealing mechanism may be used to seal at bearings 121. In the exemplary embodiment, a seal is formed by placing elastomer o-ring seals 122 between each row of bearings 121. As shown in FIGS. 1A, 1B, and 2, three elastomer o-ring seals 122 are used. Alternative embodiments may use a labyrinth seal between in inner and outer annular protrusions 113, 117, or any other suitable sealing mechanism may be used. If desired, seals 122 may be removed for re-dressing and replacement; however, due to the short working duration of seals 122, it is not anticipated that re-dressing or replacement will be necessary.

Upper and lower tubular members 109, 111 further define annular recesses 123 extending across a boundary between the upper and lower tubular members 109, 111. Annular recesses 123 extend from a surface of inner and outer tubular members 109, 111 radially inward toward central bore 101. Recesses 123 are of a shape such that corresponding engaging devices, described in more detail below, will mount substantially flush within recesses 123. Preferably, the engaging devices, such as locking arms 125 (anti-rotation member), couple to the upper tubular member 109 at an end of recesses 123 within upper tubular member 109. Locking arms 125 may then pivot between an engaged position as shown in FIGS. 1A, 1B, or a disengaged position as shown in FIG. 2. Persons skilled in the art will understand a preferred embodiment includes two recesses 123 and locking arms 125, but that the present invention contemplates and includes embodiments with more and fewer recesses 123 and locking arms 125.

Referring again to FIG. 1A, upper tubular member 109 further comprises a valve 131 proximate to recess 105 and configured to open or close central bore 101. In the illustrated embodiment, valve 131 comprises a manually operated full opening ball valve. A person skilled in the art will understand that valve 131 may operate manually, or alternatively through remote means such as with an electronic or hydraulic actuation system or the like. As illustrated in FIG. 1A, valve 131 is in the open position allowing fluid to flow through central bore 101 and the closed position in FIG. 2, preventing fluid from flowing through central bore 101 past valve 131. A valve stem is accessible through a side wall of upper tubular member 109 for operation of valve 131. In the exemplary embodiment, the valve stem does not extend to the surface of upper tubular member 109 as a safety precaution. A person skilled in the art will understand that other types of valves may be used.

Upper tubular member 109 includes at least one port with a check valve 133 proximate to and axially below valve 131. When depressed inward, check valves 133 open to allow drilling fluid to be injected into central bore 101. When rebound, check valves 133 close. In the exemplary embodiment, check valves 133 comprise side entry circulating ports allowing for passage of a fluid one way into central bore 101 through a sidewall port of RCCT 100. A portion of the exterior side wall of upper tubular member 109 at check valves 133 is recessed to accommodate a mouth seal (not shown). Check valves 133 are installed in a slotted area of the sidewall of upper tubular member 109 and secured by a stop pin (not shown) to upper tubular member 109. In the exemplary embodiment, check valves 133 are flapper valves biased to the closed position. As illustrated in FIG. 1A, check valves 133 are closed and open in FIG. 2. A single check valve rather than two is feasible. In the exemplary embodiment, two check valves 133 were selected to increase drilling fluid flowrate into central bore 101. Also, rather than a check valve a manually actuable open and close valve is feasible. In an alternative embodiment, as shown in FIG. 1B, check valves 133' are installed so that check valves 133' slant from an upper position at the exterior diameter of upper tubular member 109 to a lower position at central bore 101. The alternative embodiment reduces back pressure from the entry point.

An exemplary RCCT 100 is comprised of G-105 or S-135 grade steel and is approximately five feet long with a 4.5 inch IF top and bottom connection. In addition, the exemplary RCCT 100 is rated for 26,000 ft-lbs of rotating torque capability and 500,000 lbs tensile strength when locking arms 125 are locked. The valves and central bore can accommodate a 350 gpm pump rate with a rating of 5,000 psi static pressure and 2,500 psi dynamic pressure. When locking arms 125 are unlocked, the engagement of bearings 121 in groove 123 prevents upward movement of upper tubular member 109 relative to lower tubular member 111 due to drilling fluid being pumped through RCCT 100.

Figure 3A:
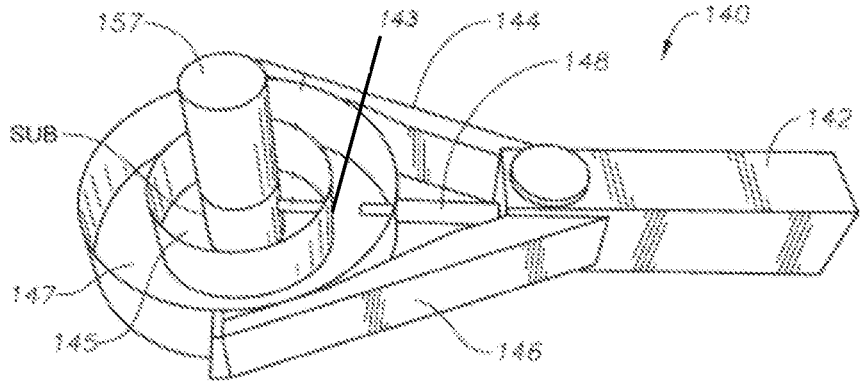
FIGS. 3A-3C illustrate schematic views of an exemplary RCCT tool or modified clad used in conjunction with the RCCT of FIG. 1, according to one embodiment of the present invention.
Figure 3B:
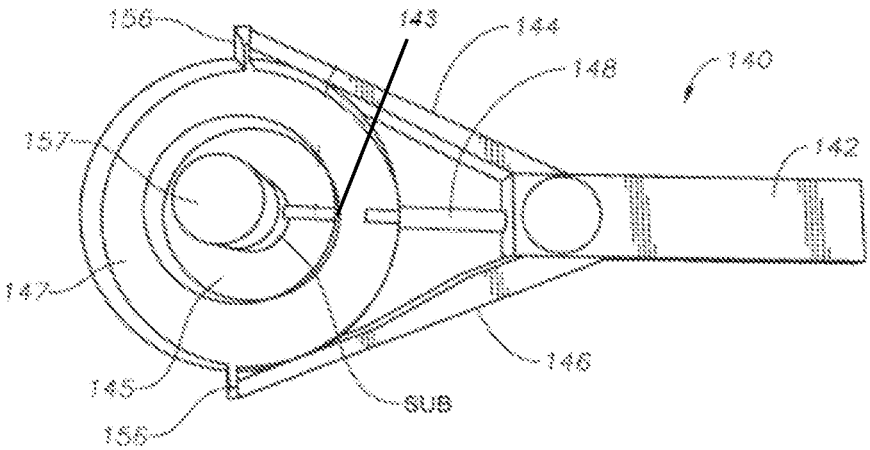
Figure 3C:
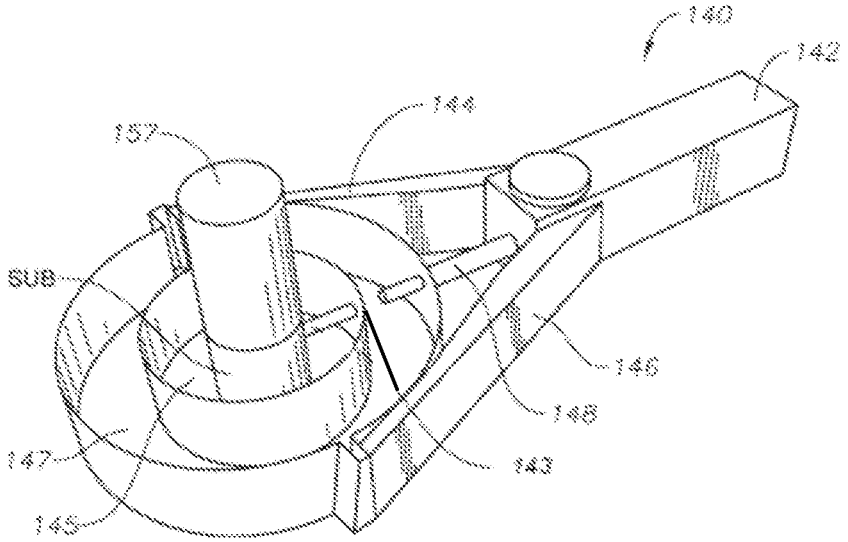

FIGS. 3A-3C illustrate schematic views of an exemplary RCCT tool or modified clad 140 used in conjunction with the RCCT of FIG. 1, according to one embodiment of the present invention. As illustrated in these figures, the modified clad 140 is configured to grip and seal around the RCCT sub. The clad 140 includes a body portion 142, an inner ring 145 configured to selectively rotate independently, and an outer ring 147 configured to be stationary with respect to the inner ring 145 when the inner ring 145 is rotated. The outer ring 147 includes at least two annular protrusions 156. The clad 140 further includes a first arm 144 configured to engage with a first annular protrusion 156, a second arm 146 configured to engage with a second annular protrusion 156. Both arms 144, 146 can be integral to the body portion 142 or may be joined separately to the body portion 142. The clad 140 further includes a stinger 148 configured to latch into the at least one side entry port 143 and allow the sub and the drill pipe string 157 to rotate independent of the clad 140. This way, the clad 140 is configured to avoid or prevent any stuck pipe incidents that may occur.

FIGS. 3A-3C illustrate a modification to the surface side entry clad 140 that connects the RCCT sub through the side valve 133 to the rig circulation system. This way, the weak points generated by the rotating part of each sub will be reduced to one at surface. In addition, the weak point can be fixed and replaced without having to trip the pipes 157 and stop drilling.

Figure 4A:
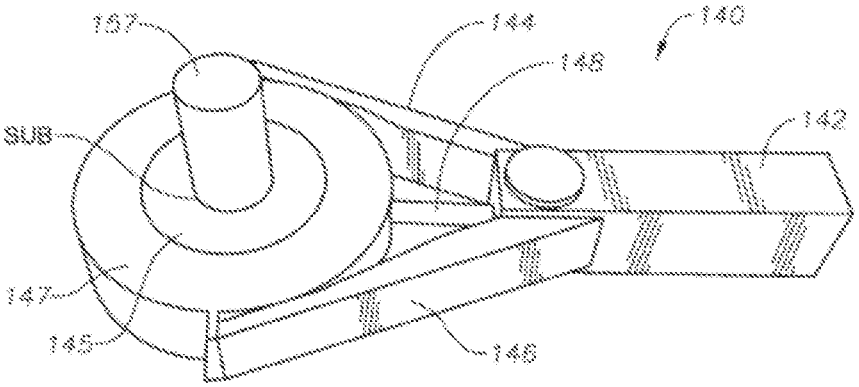
FIGS. 4A-4C illustrate schematic views of an exemplary RCCT tool or modified clad used in conjunction with the RCCT of FIG. 1, according to one embodiment of the present invention.
Figure 4B:
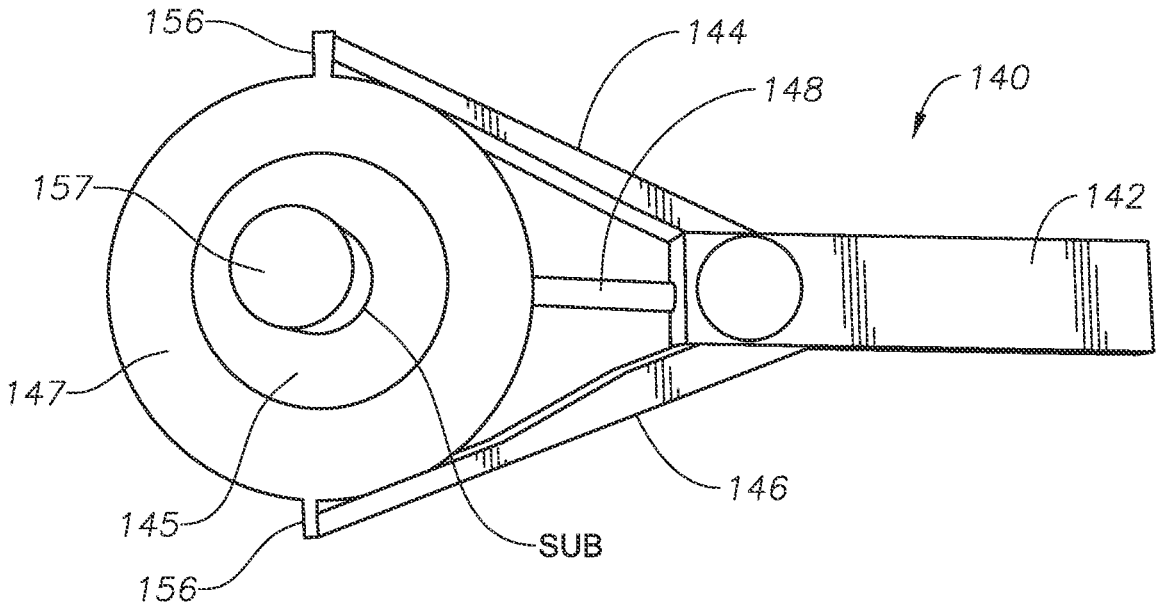
Figure 4C:
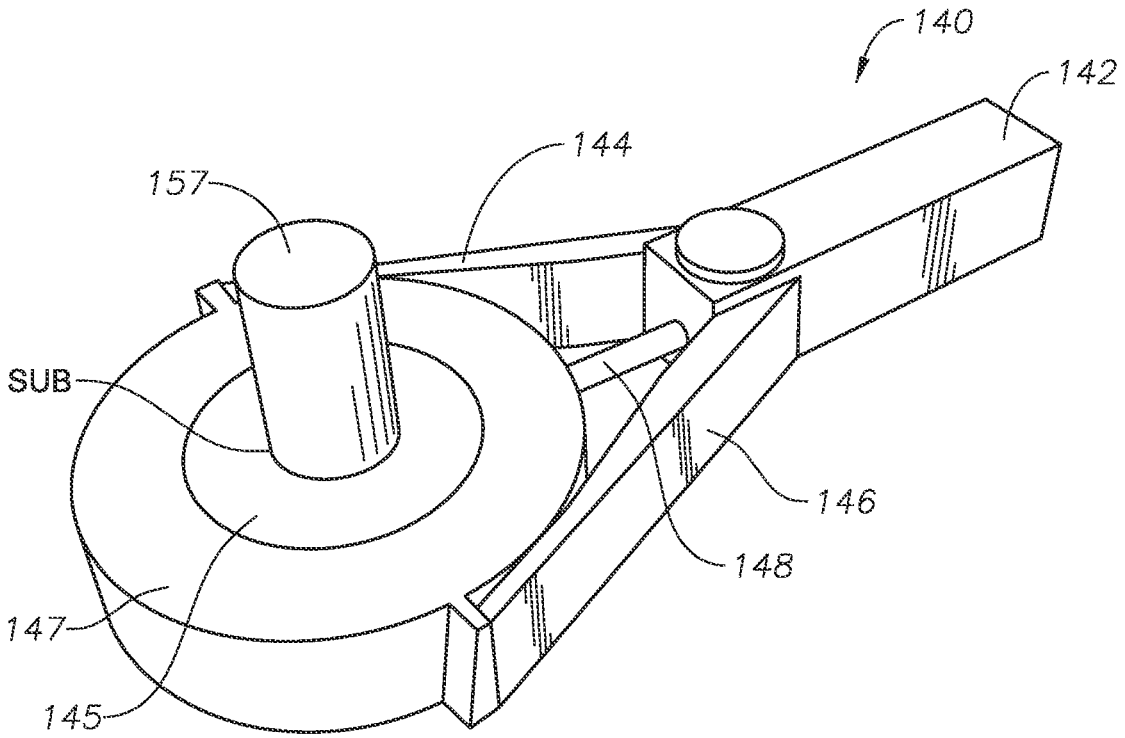

FIGS. 4A-4C illustrate schematic views of an exemplary RCCT tool or modified clad 140 used in conjunction with the RCCT of FIG. 1, according to one embodiment of the present invention. As illustrated in these figures, the modified clad 140 is configured to grip and seal around the RCCT sub. The clad 140 includes a body portion 142, an inner ring 145 configured to selectively rotate independently, and an outer ring 147 configured to be stationary with respect to the inner ring 145 when the inner ring 145 is rotated. The outer ring 147 includes at least two annular protrusions 156. The clad 140 further includes a first arm 144 configured to engage with a first annular protrusion 156, a second arm 146 configured to engage with a second annular protrusion 156. Both arms 144, 146 can be integral to the body portion 142 or may be joined separately to the body portion 142. The clad 140 further includes a stinger 148 configured to latch into the at least one side entry port and allow the sub and the drill pipe string 157 to rotate independent of the clad 140. This way, the clad 140 is configured to avoid or prevent any stuck pipe incidents that may occur.

FIGS. 4A-4C illustrate a modification to the surface side entry clad 140 that connects the RCCT sub through the side valve to the rig circulation system. This way, the weak points generated by the rotating part of each sub will be reduced to one at surface. In addition, the weak point can be fixed and replaced without having to trip the pipes 157 and stop drilling.

Figure 5:
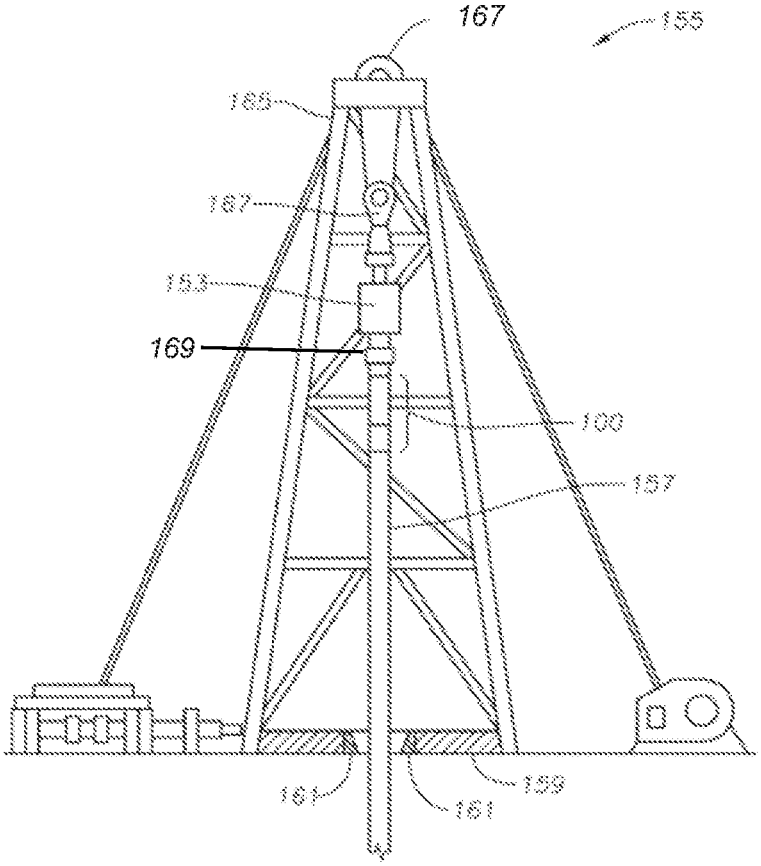
FIG. 5 is a schematic sectional illustration of a RCCT coupled to a top drive drilling rig.

Operative embodiments of the use of RCCT 100 will now be discussed with reference to FIG. 5. A person skilled in the art will understand that RCCT 100 may be used with multiple types of rig drive systems, such as a top drive system, illustrated in FIG. 5 or a kelly drive system. Referring to FIG. 5, RCCT 100 couples to a quill of top drive 153 in drilling rig 155. A pipe string 157 couples to RCCT 100 opposite top drive 153. Pipe string 157 comprises a plurality of coupled piping elements run into a wellbore having a drill bit coupled to an end of the pipe string 157 at a bottom of the wellbore. Typically, drilling mud pumps through top drive 153, through pipe string 157, and down to the drill bit where the drilling mud cools and cleans the drill bit. Continued pumping of drilling mud through top drive 153 and pipe string 157 forces drilling mud at the bottom of the wellbore back up the wellbore along the outside of pipe string 157, thereby removing drilled material from the wellbore.

As shown, pipe string 157 passes through a rotary table 161 in a rig floor 159. Rig floor 159 comprises an upper platform of drilling rig 155 providing a working space for workers as they perform various functions in the drilling process. Rig floor 159 further comprises a rotary table 161. Rotary table 161 comprises a rotationally driven element within rig floor 159 that, when engaged with pipe string 157 by a plurality of pipe slips, may hold pipe string 157 stationary within the wellbore, or variably rotate pipe string 157.

Top drive 153 moveably couples to a drilling derrick 165 through a pulley assembly 167 such that top drive 153 may move vertically over rotary table 161 along a rail (not shown), and may rotate both in a clockwise and a counter-clockwise direction in order to couple to a subsequent piping element. In the illustrated embodiment, top drive 153 provides the primary means for moving and rotating pipe string 157 and providing fluid to pipe string 157. A person skilled in the art will understand that alternative means of raising and lowering top drive 153, such as hydraulically powered lifts, are contemplated and included by the present embodiments. Drilling derrick 165 will also include an apparatus to position a pipe stand beneath quill 169.

Accordingly, the disclosed embodiments provide numerous advantages over prior devices for circulating drilling mud through a pipe string while continuing rotation of the pipe string. For example, rotation of the pipe string pauses only long enough to engage and disengage the locking arms, attach an injection tool, and close a valve. Compared to earlier prior art methods, the period where the pipe string is not rotating while using the RCCT is negligible. In addition, RCCT accomplishes near continuous rotation of the pipe string while also allowing for near continuous circulation of drilling mud through the pipe string. In this manner, the present embodiments are able to overcome many of the problems of prior art devices.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur.

While there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method operations, which perform substantially the same function in substantially the same way to achieve the same results, are within the scope of the disclosure. Moreover, it should be recognized that structures and/or elements and/or method operations shown and/or described in connection with any disclosed form or embodiment of the disclosure may be incorporated in any other disclosed or described or suggested form or embodiment as a general matter of design choice. It is the intention, therefore, to be limited only as indicated by the scope of the claims appended hereto.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described as performing the recited function and not only structural equivalents, but also equivalent structures.

The invention claimed is:

1. A rotational continuous circulation tool (RCCT) for connection into a drill pipe string comprising:

a sub defining a central bore having an axis, the sub having upper and lower ends for connection into the drill pipe string;

wherein the sub comprises an upper tubular member and a lower tubular member;

wherein the upper tubular member and the lower tubular member are configured to selectively rotate independently and in unison;

a central bore valve coupled to the upper tubular member to selectively open and close the central bore;

at least one side entry port in a sidewall of the upper tubular member axially below the central valve for selectively allowing drilling fluid to be injected into the central bore; and a clad configured to grip and seal around the sub, the clad comprising:

a body portion;

an inner ring configured to selectively rotate independently;

an outer ring configured to be stationary with respect to the inner ring, the outer ring having at least two annular protrusions;

a first arm configured to engage with a first annular protrusion;

a second arm configured to engage with a second annular protrusion; and a stinger configured to latch into the at least one side entry port and allow the sub and the drill pipe string to rotate independent of the clad.

2. The tool of claim 1, wherein the clad is configured to avoid or prevent stuck pipe incidents.

3. The tool of claim 1, further comprising bearings located between the upper and lower tubular members.

4. The tool of claim 3, wherein:

one of the tubular members comprises a main portion of a first diameter and an annular protrusion that locates within a receptacle of the other tubular member; and the bearings are located between the receptacle and the protrusion.

5. The tool of claim 1, wherein the sub further comprises an anti-rotation member accessible from an exterior of the sub for selectively locking the upper and lower tubular members together for rotation therewith and transmission of rotational torque between the upper and lower tubular members.

6. The tool of claim 5, wherein the anti-rotation member comprises a locking arm pivotally mounted to one of the tubular members and a recess located on an exterior of the other tubular member to receive the locking arm.

7. The tool of claim 6, wherein:

the locking arm pivotally couples to the upper member;

wherein the locking arm is configured to alternately pivot from a disengaged position to an engaged position;

wherein the engaged position of the locking arm places the locking arm across a boundary defined by the upper and lower tubular members;

wherein the recess extends from an exterior surface of each of the upper and lower tubular members, the recess crossing the boundary; and wherein the locking arm substantially fills the recess when in the engaged position.

8. The tool of claim 1, wherein the central bore valve comprises a ball valve.

9. The tool of claim 1, wherein the side entry port comprises a check valve that when depressed, allows drilling fluid to be injected through the side entry port into the central bore.

10. In a drilling rig having a top drive configured to pass drilling fluid through and rotate a pipe string, a system comprising:

a rotary table mounted in the drilling rig below the top drive, the rotary table configured to suspend and rotate the pipe string;

a sub defining a central bore having an axis, the sub coupled into the pipe string;

wherein the sub comprises:

an upper tubular member and a lower tubular member;

wherein the upper tubular member and the lower tubular member are configured to selectively rotate independently and in unison;

a central bore valve coupled to the upper tubular member to selectively open and close the central bore;

at least one side entry port in a sidewall of the upper tubular member axially below the central bore valve for selectively allowing drilling fluid to be injected into the central bore; and a clad configured to grip and seal around the sub, the clad comprising:

a body portion;

an inner ring configured to selectively rotate independently;

an outer ring configured to be stationary with respect to the inner ring, the outer ring having at least two annular protrusions;

a first arm configured to engage with a first annular protrusion;

a second arm configured to engage with a second annular protrusion; and a stinger configured to latch into the at least one side entry port and allow the sub and the drill pipe string to rotate independent of the clad.

11. The system of claim 10, wherein the clad is configured to avoid or prevent stuck pipe incidents.

12. The system of claim 10, wherein:

the locking arm pivotally couples to the upper member;

wherein the locking arm is configured to alternately pivot from a disengaged position to an engaged position;

wherein the engaged position of the locking arm places the locking arm across a boundary defined by the upper and lower tubular members;

wherein a recess extends from an exterior surface of each of the upper and lower tubular members, the recess crossing the boundary; and wherein the locking arm substantially fills the recess when in the engaged position.

13. The system of claim 12, wherein:

one of the tubular members comprises a main portion of a first diameter and an annular protrusion that locates within a receptacle of the other tubular member; and bearings are located between the receptacle and the protrusion.

14. A method for circulating fluid through a drill pipe string supported by a rig drive of a drilling rig while rotating the drill pipe string during make up or break out, the method comprising:

(a) connecting a rotational continuous circulation tool (RCCT) to a top of each drill pipe stand used to form the drill pipe string, the RCCT having upper and lower portions that are selectively rotatable independently of each other;

(b) with the rig drive, positioning the drill pipe string in the drilling rig until the RCCT is proximate to and above a rotary table of the drilling rig and continuing to rotate and pump drilling fluid through a top drive and the drill pipe string;

(c) engaging the drill pipe string in the rotary table;

(d) rotating the drill pipe string and the lower portion of the RCCT with the rotary table while the upper portion of the RCCT remains stationary;

(e) closing a central bore valve of the RCCT to block flow of fluid from the rig drive;

(f) inserting a modified clad into a side entry port of the upper portion of the RCCT, the clad configured to grip and seal around the RCCT, the clad comprising:

a body portion;

an inner ring configured to selectively rotate independently;

an outer ring configured to be stationary with respect to the inner ring, the outer ring having at least two annular protrusions;

a first arm configured to engage with a first annular protrusion;

a second arm configured to engage with a second annular protrusion; and a stinger configured to latch into the at least one side entry port and allow the RCCT and the drill pipe string to rotate independent of the clad;

(g) decoupling the rig drive from the RCCT;

(h) coupling another section of pipe between the rig drive and the RCCT;

(i) disengaging the pipe string from the rotary table; and (j) continuing operations with the drilling rig.

15. The tool of claim 14, wherein the clad is configured to avoid or prevent stuck pipe incidents.

16. The method of claim 14, wherein step (c) comprises:

pausing rotation of the drill pipe string; and unlocking an anti-rotation member coupled to an exterior of the RCCT, allowing independent rotation of the upper and lower portions of the RCCT.

17. The method of claim 16, wherein:

the rig drive comprises the top drive; and step (b) comprises lowering the drill pipe string with the top drive.

* * * * *